US010434621B2

(12) United States Patent
Yasuda et al.

(10) Patent No.: US 10,434,621 B2
(45) Date of Patent: Oct. 8, 2019

(54) WORKPIECE PROCESSING APPARATUS AND WORKPIECE PROCESSING METHOD

(71) Applicant: SHIN-ETSU HANDOTAI CO., LTD., Tokyo (JP)

(72) Inventors: Taichi Yasuda, Kita-ku (JP); Tatsuo Enomoto, Setagaya-ku (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 150 days.

(21) Appl. No.: 15/109,954

(22) PCT Filed: Jan. 16, 2015

(86) PCT No.: PCT/JP2015/000170
§ 371 (c)(1),
(2) Date: Jul. 6, 2016

(87) PCT Pub. No.: WO2015/115043
PCT Pub. Date: Aug. 6, 2015

(65) Prior Publication Data

US 2016/0332279 A1 Nov. 17, 2016

(30) Foreign Application Priority Data

Jan. 29, 2014 (JP) ..... 2014-014920

(51) Int. Cl.
*B24B 37/04* (2012.01)
*B24B 37/08* (2012.01)
*B24B 49/16* (2006.01)

(52) U.S. Cl.
CPC ..... *B24B 37/042* (2013.01); *B24B 37/08* (2013.01); *B24B 49/16* (2013.01)

(58) Field of Classification Search
None
See application file for complete search history.

(56) References Cited

U.S. PATENT DOCUMENTS 6,113,165 A * 9/2000 Wen ..... H01L 21/68707 294/213
6,931,330 B1 * 8/2005 Yi ..... B24B 21/04 257/E21.23

(Continued)

FOREIGN PATENT DOCUMENTS

CN 1460043 A 12/2003
CN 1480992 3/2004

(Continued)

OTHER PUBLICATIONS

Apr. 7, 2015 International Search Report issued in International Patent Application No. PCT/JP2015/000170.

(Continued)

*Primary Examiner* — Brian D Keller
(74) *Attorney, Agent, or Firm* — Oliff PLC

(57) ABSTRACT

A workpiece processing apparatus including a control unit that is provided with a storage medium on which a polishing load measured when an upper turn table is moved downward to a fixed position in a state wherein the workpiece is properly held in holding hole of the carrier is recorded in advance, calculates a difference between a polishing load measured when upper turn table is moved downward to the fixed position in a state wherein the workpiece is held in holding hole of the carrier and the polishing load recorded on the storage medium, and judges the occurrence of abnormal holding of the workpiece if the calculated difference exceeds a threshold value. As a result, it becomes possible to detect abnormal holding of a workpiece in a short time with a high degree of precision before the workpiece is processed and prevent breakages of the workpiece and the processing apparatus.

6 Claims, 6 Drawing Sheets

(56) References Cited

U.S. PATENT DOCUMENTS

| | | | | |
|---|---|---|---|---|
| 2002/0052064 | A1 | 5/2002 | Grabbe et al. | |
| 2003/0104698 | A1* | 6/2003 | Taniguchi | B24B 37/042 438/692 |
| 2008/0227371 | A1 | 9/2008 | Onishi et al. | |
| 2009/0042392 | A1* | 2/2009 | Tokura | B24B 37/08 438/692 |
| 2011/0130073 | A1 | 6/2011 | Furukawa et al. | |
| 2014/0134924 | A1* | 5/2014 | Shinozaki | B24B 7/228 451/5 |
| 2014/0320867 | A1 | 10/2014 | Kanno | |

FOREIGN PATENT DOCUMENTS

| | | | |
|---|---|---|---|
| CN | 101264585 | A | 9/2008 |
| CN | 101362308 | A | 2/2009 |
| CN | 102089121 | A | 6/2011 |
| JP | H02-106269 | A | 4/1990 |
| JP | H04-25311 | A | 1/1992 |
| JP | H08-216016 | A | 8/1996 |
| JP | 2005-243996 | A | 9/2005 |
| JP | 2013-078826 | A | 5/2013 |

OTHER PUBLICATIONS

Apr. 27, 2017 Search Report issued in Chinese Patent Application No. 2015800066641.

* cited by examiner

WORKPIECE PROCESSING APPARATUS AND WORKPIECE PROCESSING METHOD

TECHNICAL FIELD

The present invention relates to a method and an apparatus that prevent a fracture in a workpiece by detecting that a workpiece is not properly put in a holding hole of a carrier prior to processing in processing of a workpiece by which the workpiece is held in the holding hole of the carrier and both surfaces of the workpiece are processed at the same time.

BACKGROUND ART

In the past, when, for example, a thin plate-like workpiece such as a silicon wafer is flattened, a double-side polishing apparatus or a double-side lapping apparatus has been used. For example, the double-side polishing apparatus has a disk-shaped carrier with a planet gear at the outer edge thereof between upper and lower turn tables to which a polishing pad formed of urethane foam or a nonwoven fabric is attached. By holding a workpiece in a holding hole of this carrier and mutually rotating a sun gear and an internal gear which engage the planet gear, the rotation and orbital motion of the carrier are generated. By this rotation and orbital motion and the rotation of the upper and lower turn tables and the sliding motion of the upper and lower turn tables and the workpiece, the upper and lower surfaces of the workpiece are polished at the same time. During polishing, in order to perform polishing efficiently, polishing slurry is supplied from a plurality of holes provided in the upper turn table.

The upper turn table is provided with an up-and-down motion mechanism and, in a position to which the upper turn table is moved upward, the carrier is disposed and a workpiece is held by the carrier. There are a case where holding of the workpiece is performed manually by an operator and a case where holding of the workpiece is performed by using an automatic handling apparatus (refer to, for example, Patent Document 1). After the workpiece is held, the upper turn table is moved downward, whereby the workpiece and the carrier are interposed between the upper and lower turn tables.

In order to control the polishing rate, there are a method of changing the sliding rate of the workpiece and the upper and lower turn tables by changing the rotation rates of the upper and lower turn tables, the sun gear, and the internal gear and a method of controlling a polishing load.

An upper turn table holding section is usually provided with a measuring instrument that measures the weight of the upper turn table. For example, when the upper turn table is in a position to which the upper turn table is moved upward, the measuring instrument measures the total weight of the upper turn table. In a position in which the upper turn table is moved fully downward, since the total weight of the upper turn table is applied to the workpiece and the carrier, the weight of the upper turn table measured by the measuring instrument becomes zero. When the upper turn table is gradually moved upward from the position in which the upper turn table is moved fully downward, the weight of the upper turn table applied only to the workpiece and the carrier starts to be gradually supported by the upper turn table holding section. That is, by appropriately controlling the height position of the upper turn table, it is possible to apply a desired polishing load to the workpiece and the carrier.

CITATION LIST

Patent Literature

Patent Document 1: JP-A-2005-243996
Patent Document 2: JP-A-2013-78826

SUMMARY OF INVENTION

Technical Problem

If a workpiece is polished in a state in which the workpiece held by the carrier is not properly put in the holding hole of the carrier, that is, a state in which abnormal holding of the workpiece has occurred, the workpiece flies out of the holding hole and is broken. In this case, instead of merely causing a breakage of the workpiece which has flown out of the carrier, there is a high possibility that chain reaction breakages of the other workpiece and the carrier are also caused. In addition, the gear, the polishing pad, and the turn table of the apparatus are sometimes broken.

This undesirably results in a reduction in yields caused by a breakage of the workpiece, a reduction in productivity caused by the processing apparatus restoration work, and an increase in cost caused by the replacement of the broken apparatus part and polishing pad.

As a cause of abnormal holding of a workpiece, there are a case where the workpiece is not properly inserted into the holding hole from the beginning and a case where the workpiece is properly inserted into the holding hole but lies out of the holding hole due to the rotation of the turn tables, for example, before the start of polishing. It is believed that such abnormal holding is caused by a simple operation mistake when holding of a workpiece is performed manually by the operator and is caused by insufficient functioning of the apparatus due to a breakdown or the like when holding of a workpiece is performed by using the automatic handling apparatus.

The following is believed to be the reason why the workpiece properly inserted into the holding hole lies out of the holding hole before the start of polishing.

The water or slurry collected in the holding hole of the carrier placed on the lower turn table gives buoyancy to the workpiece and makes the workpiece easily lie out of the holding hole. More specifically, in common double-side polishing apparatus and double-side lapping apparatus, one carrier is often capable of holding one workpiece or a plurality of workpieces and a plurality of carriers, for example, five carriers are often provided in the apparatus at regular intervals, that is, at an interval of 72°. When a workpiece is held by a carrier, a target carrier of the plurality of carriers is moved to a specific workpiece set position by rotating the internal gear and the sun gear. The operator manually makes the carrier disposed in this specific set position hold the workpiece or the automatic handling apparatus makes the carrier hold the workpiece. After wafer holding performed by the carrier in this specific set position is finished, by rotating the internal gear and the sun gear 72° in the same direction, a carrier which is immediately next to the above carrier is then moved to the work set position (this operation is sometimes called index of carriers). By repeating these holding of a workpiece and index five times, all of the five carriers are each made to hold the workpiece. Under the above-described conditions that allow the workpiece to acquire buoyancy and easily lie out of the carrier, when the carrier is moved and rotated as in index, there is a possibility that the workpiece lies out of the carrier.

In order to detect abnormal holding of a workpiece, manual verification is sometimes performed by the operator after making the carrier hold the workpiece, but it is not efficient to make the operator directly perform such manual verification because it takes time to do so.

Moreover, a method of judging the occurrence of abnormal holding of a workpiece if a difference between the height position of an upper turn table detected by a laser displacement sensor and a reference position exceeds a threshold value is known (refer to Patent Document 2). However, this method causes an increase in cost for introducing the laser displacement sensor.

The present invention has been made in view of the problems described above, and an object thereof is to provide a processing apparatus and a processing method that can detect abnormal holding of a workpiece in a short time with a high degree of precision at low cost before the workpiece is processed and prevent breakages of the workpiece and the processing apparatus.

Solution to Problem

To attain the above-described object, the present invention provides a workpiece processing apparatus that processes both surfaces of a workpiece at the same time by holding the workpiece in a holding hole of a carrier by inserting the workpiece thereinto, moving an upper turn table downward to a fixed position, and interposing the carrier holding the workpiece between the upper turn table and a lower turn table, the workpiece processing apparatus including a control unit that is provided with a storage medium on which a polishing load measured when the upper turn table is moved downward to the fixed position in a state in which the workpiece is properly held in the holding hole of the carrier is recorded in advance, calculates a difference between a polishing load measured when the upper turn table is moved downward to the fixed position in a state in which the workpiece is held in the holding hole of the carrier and the polishing load recorded on the storage medium, and judges the occurrence of abnormal holding of the workpiece if the calculated difference exceeds a threshold value.

With such a processing apparatus, it is possible to detect abnormal holding of a workpiece in a short time with a high degree of precision at low cost before the workpiece is processed. This makes it possible to prevent breakages of the workpiece and the processing apparatus efficiently and improve productivity.

The workpiece processing apparatus may be a double-side polishing apparatus or a double-side lapping apparatus.

In this case, it is preferable that the control unit is a control unit that is capable of updating the polishing load recorded on the storage medium in advance in accordance with temporal changes in a polishing pad of the double-side polishing apparatus or a lapping turn table of the double-side lapping apparatus.

With such a control unit, it is possible to prevent an incorrect judgment of the occurrence of abnormal holding of a workpiece from being made by a temporal reduction in the thickness of the polishing pad or the lapping turn table and prevent breakages of the workpiece and the processing apparatus for a long period of time.

Moreover, the present invention provides a workpiece processing method of processing both surfaces of a workpiece at the same time by holding the workpiece in a holding hole of a carrier by inserting the workpiece thereinto, moving an upper turn table downward to a fixed position, and interposing the carrier holding the workpiece between the upper turn table and a lower turn table, the workpiece processing method including steps of: recording in advance a polishing load measured when the upper turn table is moved downward to the fixed position in a state in which the workpiece is properly held in the holding hole of the carrier; calculating a difference between a polishing load measured when the upper turn table is moved downward to the fixed position in a state in which the workpiece is held in the holding hole of the carrier and the recorded polishing load; and judging the occurrence of abnormal holding of the workpiece if the calculated difference exceeds a threshold value and processing the workpiece after performing holding of the workpiece again and processing the workpiece as is if the calculated difference does not exceed the threshold value.

With such a processing method, it is possible to detect abnormal holding of a workpiece in a short time with a high degree of precision at low cost before the workpiece is processed. This makes it possible to prevent breakages of the workpiece and the processing apparatus efficiently and improve productivity.

Processing performed on the workpiece may be double-side polishing or double-side lapping.

In this case, it is preferable to include a step of updating the polishing load recorded in advance in accordance with temporal changes in a polishing pad which is used in the double-side polishing or a lapping turn table which is used in the double-side lapping.

By doing so, it is possible to prevent an incorrect judgment of the occurrence of abnormal holding of a workpiece from being made by a temporal reduction in the thickness of the polishing pad or the lapping turn table and prevent breakages of the workpiece and the processing apparatus for a long period of time.

Advantageous Effects of Invention

In the present invention, in processing of a workpiece, since it is judged that abnormal holding of a workpiece has occurred if a polishing load measured when an upper turn table is moved downward to a fixed position in a state in which the workpiece is held in a holding hole of a carrier shows a difference greater than or equal to a threshold value from a polishing load under normal conditions, it is possible to detect abnormal holding of a workpiece in a short time with a high degree of precision at low cost before the workpiece is processed. By holding the workpiece again depending on the detection result, it is possible to prevent efficiently breakages and breakdowns of the workpiece and the processing apparatus such as the carrier and peripheral parts. This makes it possible to prevent a reduction in yields caused by a breakage of the workpiece, a reduction in productivity caused by the restoration of the processing apparatus, and an increase in cost caused by the replacement of the broken part and polishing pad.

DESCRIPTION OF EMBODIMENTS

Hereinafter, an embodiment of the present invention will be described, but the present invention is not limited thereto.

The inventors of the present invention conducted a study to attain the above-described object of efficiently detecting abnormal holding of a workpiece at low cost. As a result, the inventors have found that a polishing load which is applied to a workpiece when abnormal holding of the workpiece has occurred becomes larger than a polishing load which is applied under normal conditions and, by evaluating a difference between these polishing loads, it is possible to detect abnormal holding of the workpiece in a short time and completed the present invention.

First, a workpiece processing apparatus of the present invention will be described. This processing apparatus processes both surfaces of a workpiece at the same time by holding, for example, a thin plate-like workpiece such as a silicon wafer in a holding hole of a carrier by inserting the workpiece thereinto and interposing the carrier holding the workpiece between an upper turn table and a lower turn table by moving the upper turn table to a fixed position, and examples thereof include a double-side polishing apparatus and a double-side lapping apparatus. Here, the double-side polishing apparatus is taken up as an example and will be described with reference to FIG. 1.

Figure 1:
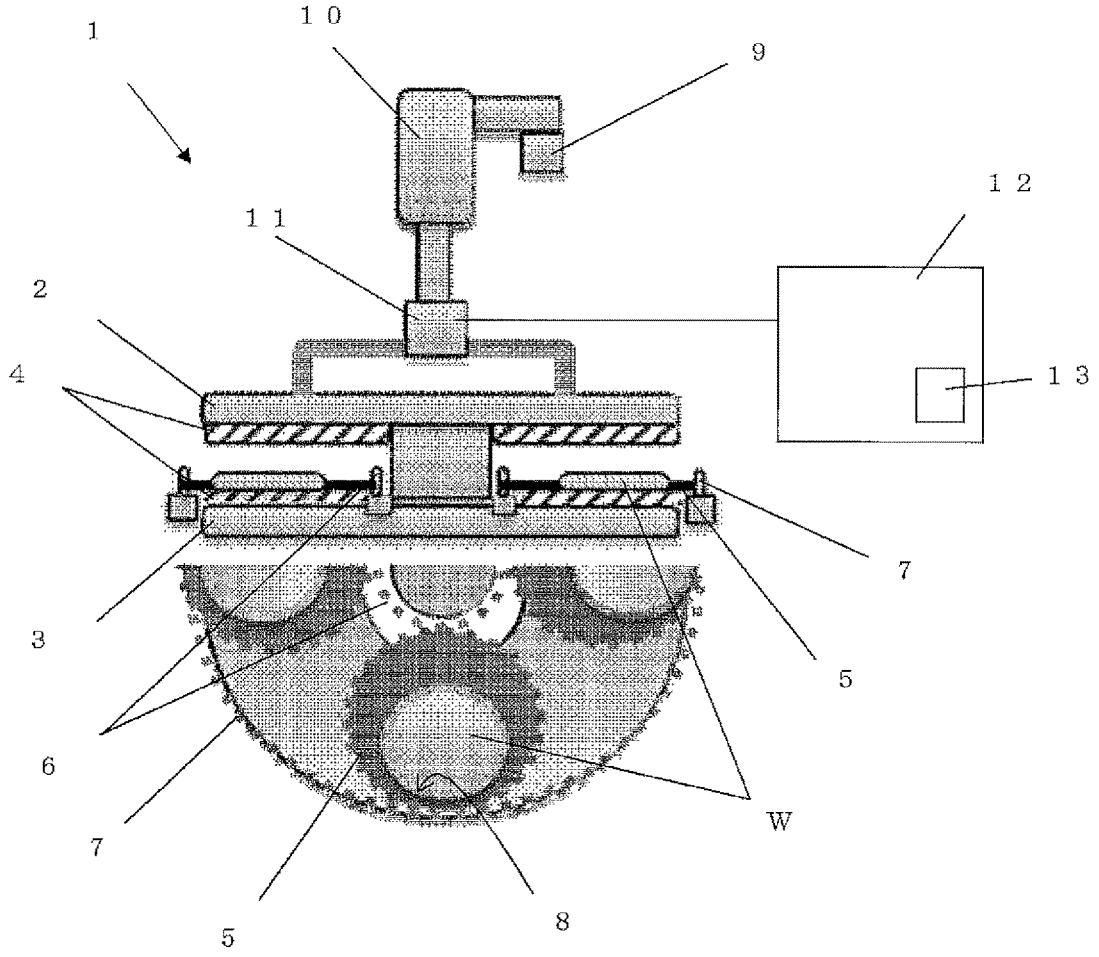
FIG. 1 is a schematic view depicting a double-side polishing apparatus as an example of a processing apparatus of the present invention.

As depicted in FIG. 1, a double-side polishing apparatus 1 of the present invention includes an upper turn table 2 and a lower turn table 3 which are provided so as to face each other vertically, and, to each of the turntables 2 and 3, a polishing pad 4 is attached. At the center between the upper turn table 2 and the lower turn table 3, a sun gear 6 is provided, and, at the outer edge thereof, an internal gear 7 is provided. In a carrier 5, a holding hole 8 for holding a workpiece W is formed. At the time of double-side polishing, the carrier 5 is disposed between the upper turn table 2 and the lower turn table 3 in a state in which the carrier 5 holds the workpiece W in the holding hole 8.

Outer teeth of the carrier 5 engage the teeth of the sun gear 6 and the internal gear 7, and, as a result of the upper turn table 2 and the lower turn table 3 being rotated by an unillustrated drive source, the carrier 5 revolves around the sun gear 6 while rotating on its own axis. At this time, both surfaces of the workpiece W held in the holding hole 8 of the carrier 5 are polished at the same time by the upper and lower polishing pads 4. At the time of polishing of the workpiece, polishing slurry is supplied to the polished surfaces of the workpiece via a plurality of through holes provided in the upper turn table 2 from an unillustrated nozzle.

Figure 2:
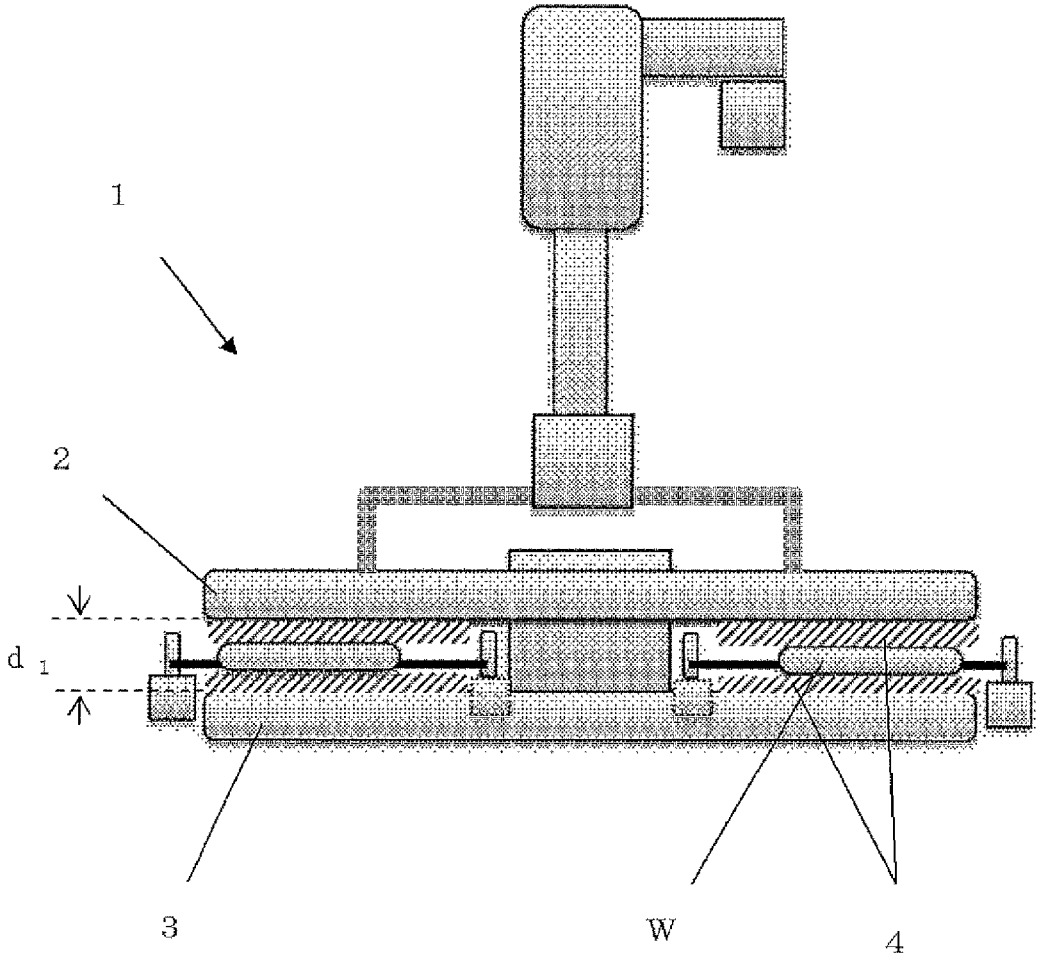
FIG. 2 is a schematic view depicting a state in which, in the double-side polishing apparatus of FIG. 1, a carrier by which a workpiece is properly held is interposed between upper and lower turn tables.

The upper turn table 2 can move upward and downward by a servomotor 9 and a servomotor cylinder 10 and the height position thereof can be controlled accurately. At a lower end of a shaft of the servomotor cylinder 10 from which the upper turn table 2 is hung, a load cell 11 which is coupled to the upper turn table 2 and measures a downward load is provided. As depicted in FIG. 1, the load which is measured by the load cell 11 indicates the total weight of the upper turn table 2 when the upper turn table 2 is moved upward and the upper polishing pad 4 is not in contact with the workpiece W. As depicted in FIG. 2, when the upper turntable 2 is moved downward and the upper polishing pad 4 is in contact with the workpiece W, part of the total weight of the upper turn table 2 is supported by the workpiece W on the lower turn table 3. This part of the weight supported by the workpiece W is the polishing load which is applied to the workpiece W. Therefore, the load which is measured by the load cell 11 at this time indicates a difference between the total weight of the upper turn table 2 and the polishing load which is applied to the workpiece W.

As described above, from a difference between the load which is measured by the load cell 11 and the total weight of the upper turntable 2, the polishing load which is applied to the workpiece W can be calculated. It is possible to control this polishing load by adjusting the height position of the upper turn table 2. The height position of the upper turntable 2 at which a desired polishing load can be obtained is used as a fixed position, and, at the time of polishing, the upper turn table 2 is always moved downward to the same fixed position each time.

The carrier 5 can be made to hold the workpiece W by manual operation which is performed by an operator, but a robot arm that transports the workpiece W to the holding hole 8 of the carrier 5 and inserts the workpiece W into the holding hole 8 may be provided.

Furthermore, the double-side polishing apparatus 1 has a control unit 12 provided with a storage medium 13. On this storage medium 13, a reference polishing load (hereinafter sometimes referred to as a polishing load under normal conditions) measured when the upper turn table 2 is moved downward to the fixed position in a state in which the workpiece W is properly held in the holding hole 8 of the carrier 5 is recorded in advance. For example, the storage medium 13 may be provided as an electronic medium connected to the control unit 12 to make it possible to provide the control unit 12 with the function of recording the above-described reference polishing load on the storage medium 13 and the function of reading the reference polishing load from the storage medium 13.

The control unit 12 is connected to the load cell 11 and can receive the load measured by the load cell 11 and calculate the polishing load from a difference between the load and the total weight of the upper turn table 2. Moreover, the control unit 12 has a control program that calculates a difference between the polishing load measured when the upper turn table 2 is moved downward to the fixed position in a state in which the workpiece W is held in the holding hole 8 of the carrier and the above-mentioned polishing load under normal conditions and, if the calculated difference exceeds a threshold value, judges the occurrence of abnormal holding of the workpiece W.

Here, judgment of the occurrence of abnormal holding of the workpiece will be described in more detail.

Figure 3:
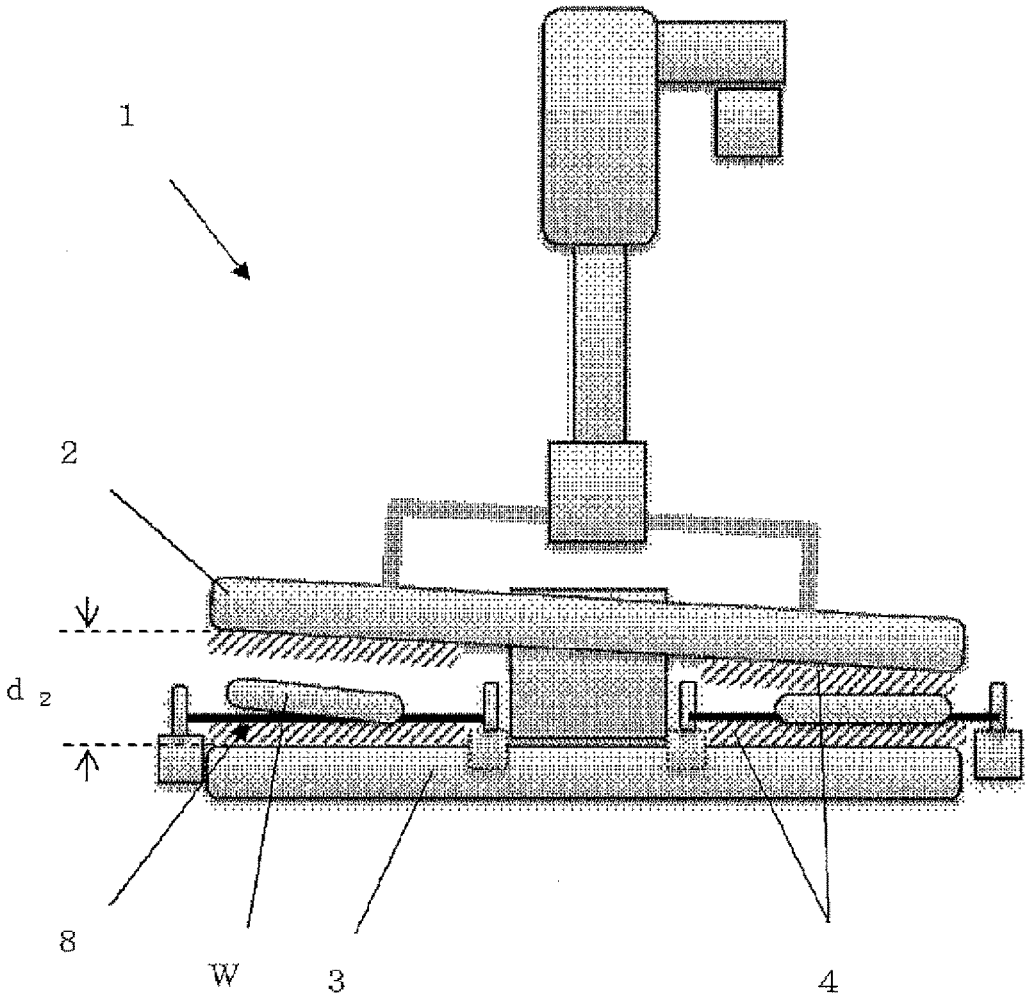
FIG. 3 is a schematic view depicting a state in which, in the double-side polishing apparatus of FIG. 1, a carrier by which a workpiece is not properly held is interposed between the upper and lower turn tables.

As depicted in FIG. 3, when abnormal holding of the workpiece W has occurred, that is, part or the whole of the workpiece W lies out of the holding hole 8, the height position of the upper turn table 2 observed when the upper polishing pad 4 makes contact with the workpiece W is higher than the height position observed under normal conditions. At this time, even when the upper turn table 2 is moved downward to the fixed position, the height position of the upper turn table 2 is actually higher than the fixed position because the workpiece W lies out of the holding hole. Therefore, clearance $d_2$ (refer to FIG. 3) between the upper and lower turn tables becomes larger than clearance $d_1$ (refer to FIG. 2) between the upper and lower turn tables under normal conditions.

Therefore, as described earlier, since the upper turn table 2 is always moved downward to the same fixed position, a polishing load which is applied to the workpiece under abnormal conditions becomes larger than a polishing load which is applied thereto under normal conditions. Thus, the control program judges that abnormal holding of the workpiece W has occurred if a difference between the calculated polishing load and the polishing load under normal conditions exceeds a threshold value. Here, the threshold value is not limited to a particular threshold value and can be determined as appropriate depending on the type of the processing apparatus, the sizes of the workpiece and the upper and lower turn tables, variations in the polishing load which is measured when abnormal holding of a workpiece has occurred, and so forth. The variations in the polishing load here are caused by a difference in the state of abnormal holding, such as the extent to which the workpiece lies out of the holding hole, the number of workpieces in which abnormal holding has occurred, or the direction in which the workpiece lies out of the holding hole with respect to the holding hole.

With such a processing apparatus of the present invention, it is possible to detect abnormal holding of the workpiece W with a high degree of precision in a short time before the workpiece W is processed. This makes it possible to prevent breakages of the workpiece and the processing apparatus efficiently and improve productivity. Moreover, since it is necessary only to provide a control unit and there is no need to introduce a new measuring instrument such as a laser displacement sensor, it is possible to control an increase in cost.

The thickness of the polishing pad 4 used in the double-side polishing apparatus 1 is gradually reduced by wearing out during polishing and regular dressing. Moreover, the thickness of the carrier is also gently reduced in accordance with the length of time the carrier is used. Therefore, the clearance between the upper and lower turn tables observed when the upper turn table 2 is moved downward to the above-described fixed position when the workpiece is held properly is gradually increased in accordance with a reduction in the thickness of the polishing pad 4 and the carrier 5. Since this increase in the clearance reduces the polishing load which is applied to the workpiece W, the polishing load under normal conditions decreases with time.

Thus, it is preferable that the control unit 12 has the function of updating the polishing load under normal conditions, the polishing load recorded on the storage medium 13 in advance, in accordance with temporal changes in the polishing pad 4 of the double-side polishing apparatus 1. When the processing apparatus of the present invention is a double-side lapping apparatus which will be described later, the polishing load under normal conditions is updated in accordance with temporal changes in a lapping turn table of the double-side lapping apparatus. The temporal changes here are changes in thickness, for example, as described above.

As for the polishing load under normal conditions which is to be updated, how the polishing load under normal conditions changes in accordance with temporal changes in the polishing pad 4 is recorded on the storage medium 13, and the polishing load under normal conditions can be updated based on the recorded changes in the polishing load. Alternatively, the polishing load under normal conditions may be updated to the average value of the polishing loads in the most recently performed several operations of processing of the workpiece. This function of updating the polishing load under normal conditions by the control unit 12 can be automated.

The polishing load under normal conditions may be updated in accordance with temporal changes in the carrier 5 in addition to the above-described temporal changes in the polishing pad 4.

By doing so, it becomes possible to deal with temporal variations in the polishing load under normal conditions. The rate of reduction in the thickness of the polishing pad 4 is very low, and, by automatically updating the polishing load under normal conditions, it is possible to detect an abnormal condition with a higher degree of precision without impairing reliability even when temporal changes occur in the polishing pad or the lapping turn table.

In the above description, explanations have been given by taking up the double-side polishing apparatus as an example of the processing apparatus of the present invention, but the present invention can also be applied to a double-side lapping apparatus and it is possible to obtain the same effects as those described above.

Figure 4:
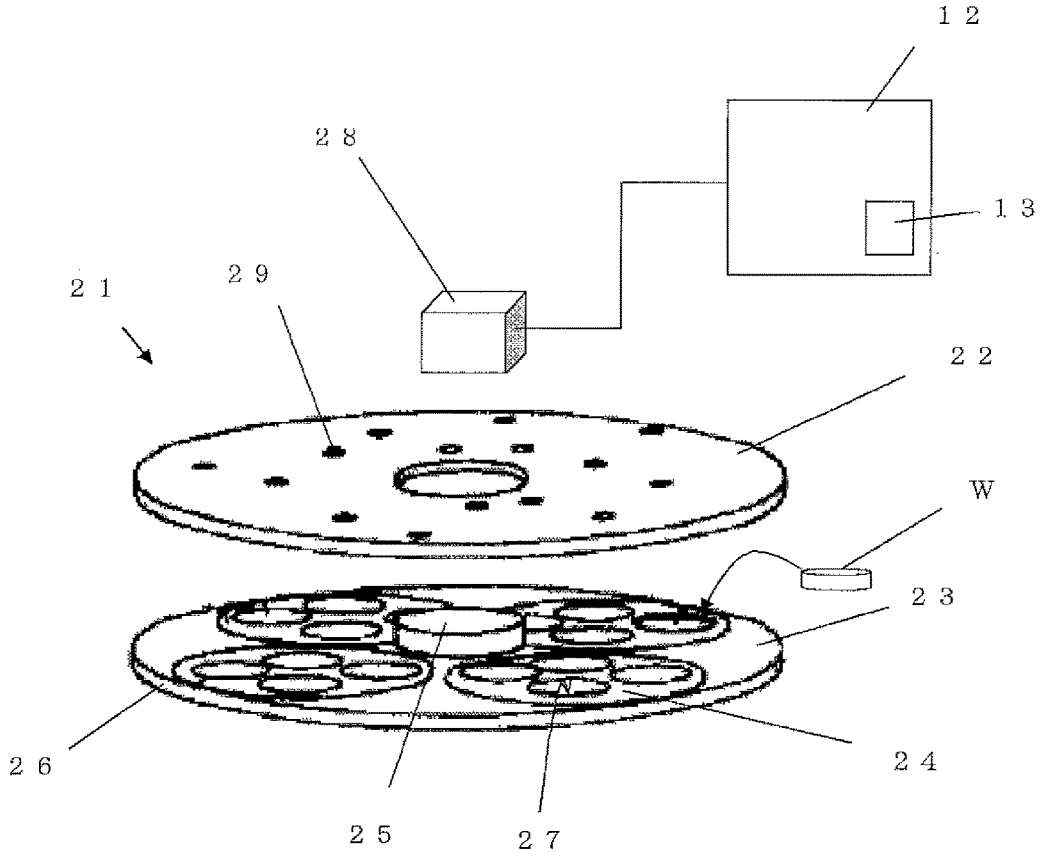
FIG. 4 is a schematic view depicting a double-side lapping apparatus as an example of the processing apparatus of the present invention.

In FIG. 4, a double-side lapping apparatus of the present invention is depicted. As depicted in FIG. 4, a double-side lapping apparatus 21 includes upper and lower turn tables 22 and 23 (lapping turn tables) provided so as to face each other vertically. The lower turn table 23 has a sun gear 25 at the center on the top surface thereof, and a ring-shaped internal gear 26 is provided at the outer edge thereof. Moreover, on the outer periphery of a carrier 24 which holds a workpiece W, a gear section engaging the sun gear 25 and the internal gear 26 is formed, and they form a gear structure as a whole.

The carrier 24 is provided with a plurality of holding holes 27. A workpiece W to be lapped is held by being inserted into this holding hole 27. The carrier 24 is interposed between the upper and lower turn tables 22 and 23 and produces planetary gear motion, that is, revolves and rotates on its axis as a result of the rotation of the lower turn table 23. At this time, slurry is supplied to the workpiece W and between the upper and lower turn tables 22 and 23 via through holes 29 provided in the upper turn table 22 from a nozzle and both surfaces of the workpiece W are lapped.

In the same way the case with the description of the above-described double-side polishing apparatus, there are provided a load cell 28 above the upper turn table 22, the load cell 28 measuring a load in the direction of the upper turn table 22, and a control unit 12 connected to this load cell 28. Incidentally, though not depicted in FIG. 4, the load cell 28 and the upper turn table 22 are coupled to each other. It is possible to calculate a polishing (lapping) load which is applied to the workpiece W from the load measured by the load cell 28. Moreover, it is possible to calculate, by the control unit 12, a difference between a polishing load measured when the upper turn table 22 is moved downward to a fixed position in a state in which the workpiece W is held in the holding hole 27 of the carrier 24 and a polishing load under normal conditions which is recorded on a storage medium 13 and judge the occurrence of abnormal holding of the workpiece W if the calculated difference exceeds a threshold value.

Next, a workpiece processing method of the present invention will be described. Here, a case where double-side polishing is performed on a workpiece by using the double-side polishing apparatus 1 of the present invention depicted in FIG. 1 will be described as an example.

As is the case with the description of the above-described double-side polishing apparatus, a polishing load (a polishing load under normal conditions) measured when the upper turn table 2 is moved downward to the fixed position in a state in which a workpiece W is properly held in the holding hole 8 of the carrier 5 is recorded in advance.

Then, a workpiece W to be polished is inserted into the holding hole 8 of the carrier 5 manually by the operator or by a robot arm and held therein, the upper turn table 2 is moved downward to the fixed position, and the carrier 5 holding the workpiece W is interposed between the upper turn table 2 and the lower turn table 3.

In this state, a polishing load which is applied to the workpiece W is calculated from the load measured by the load cell 11 and a difference between the calculated polishing load and the recorded polishing load under normal conditions is calculated. If the calculated difference does not exceed the threshold value, the workpiece W is polished as is; if the calculated difference exceeds the threshold value, it is judged that abnormal holding of the workpiece W has occurred and holding of the workpiece W is performed again.

After holding of the workpiece W is performed again, it is checked whether or not the workpiece is properly held. This check may be conducted by making a judgment again as to whether the difference between the polishing loads calculated in the above-described manner does not exceed the threshold value or, when, in particular, the number of workpieces whose holding was performed again is small, a check may be conducted by the operator.

Then, by rotating the upper turn table 2 and the lower turn table 3 while supplying polishing slurry to the polished surfaces of the workpiece, both surfaces of the workpiece W are polished at the same time by the upper and lower polishing pads 4.

With such a processing method of the present invention, it is possible to detect abnormal holding of a workpiece in a short time with a high degree of precision at low cost before the workpiece is processed. This makes it possible to prevent breakages of the workpiece and the processing apparatus efficiently and improve productivity.

As is the case with the description of the above-described double-side polishing apparatus, it is preferable to update the polishing load recorded in advance in accordance with temporal changes in the polishing pad (the lapping turn table in the case of double-side lapping) which is used in double-side polishing.

By doing so, it is possible to prevent an incorrect judgment of the occurrence of abnormal holding of a workpiece from being made by a temporal reduction in the thickness of the polishing pad or the lapping turn table and prevent breakages of the workpiece and the processing apparatus for a long period of time.

EXAMPLES

Hereinafter, the present invention will be described more specifically with Examples of the present invention and Comparative Example, but the present invention is not limited by these examples.

Example 1

By using the workpiece processing apparatus (the double-side polishing apparatus) of the present invention depicted in FIG. 1, double-side polishing of a silicon wafer with a diameter of 300 mm was performed in accordance with the workpiece processing method of the present invention. Incidentally, it is assumed that the double-side polishing apparatus includes a total of five carriers, each having one holding hole.

First, a polishing load under normal conditions was measured and recorded on the storage medium. The recorded polishing load under normal conditions was the average value of the polishing loads obtained by the measurement performed more than once.

Next, in order to determine a threshold value, abnormal holding of a wafer was intentionally caused and a polishing load at this time was measured. Specifically, variations in the polishing load were measured by changing the state of abnormal holding of the wafer, such as displacing the wafer to a small extent, displacing the wafer to a large extent, displacing the wafer to the sun gear side, displacing the wafer to the internal gear side, displacing the wafer leftward (in a CW direction) with respect to the center of rotation of the turn table, displacing the wafer rightward (in a CCW direction) with respect to the center of rotation of the turn table, displacing one wafer, and displacing two wafers.

Figure 5:
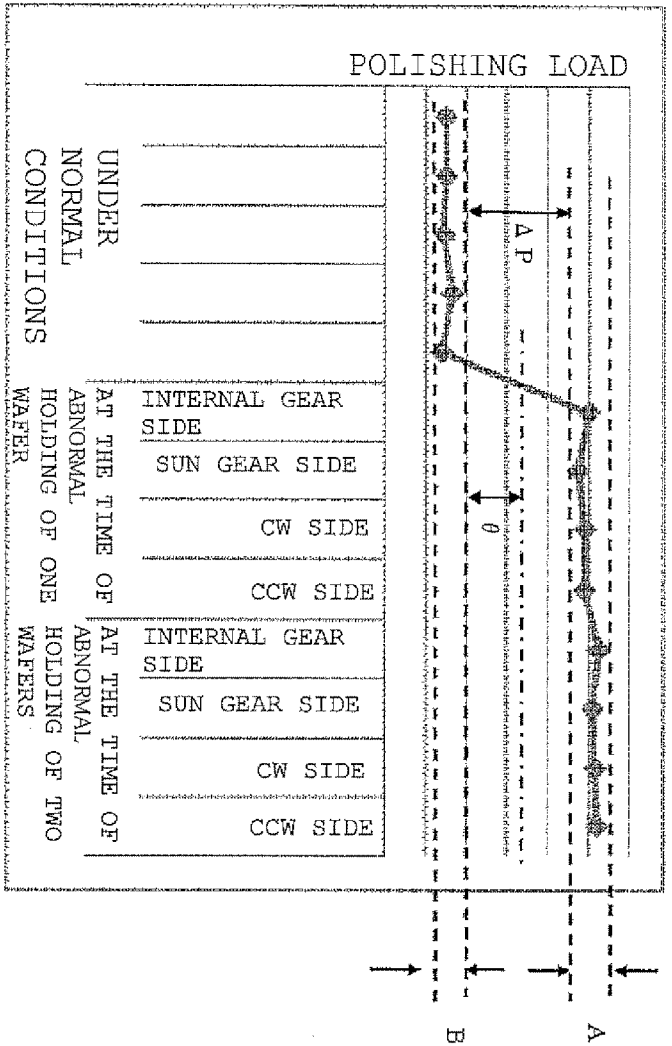
FIG. 5 is a diagram indicating the results of a polishing load in Example 1.

The results of the measured polishing loads are indicated in FIG. 5. FIG. 5 indicates the polishing load distributions under normal conditions and under abnormal conditions, and a polishing load distribution B under normal conditions is not included in a polishing load distribution A under abnormal conditions and explicitly indicates low values.

Based on a difference ($\Delta P$ in FIG. 5) between the two polishing loads, a threshold value ($\theta$ in FIG. 5) was determined.

Then, each of a total of five wafers was held by a corresponding one of the five carriers and the upper turn table was moved downward to the fixed position. A polishing load at this time was measured, and a difference between this polishing load and the above-described recorded polishing load under normal conditions was calculated. A case where the calculated difference exceeded the above-described determined threshold value was judged to be abnormal holding, holding of the wafer was performed again, and polishing was performed. When such polishing of the wafer was repeatedly performed and the precision of judgment of abnormal holding was evaluated, abnormal holding could be judged correctly with a probability of 100%. Thus, no breakage of the wafer occurred.

Since this abnormal holding judgment processing could be performed in a remarkably short time, productivity could be improved as compared to the existing verification method manually performed by the operator.

Example 2

Double-side polishing of a silicon wafer was performed in the same manner as in Example 1 except that the polishing load under normal conditions was updated in accordance with temporal changes in the polishing pad.

Figure 6:
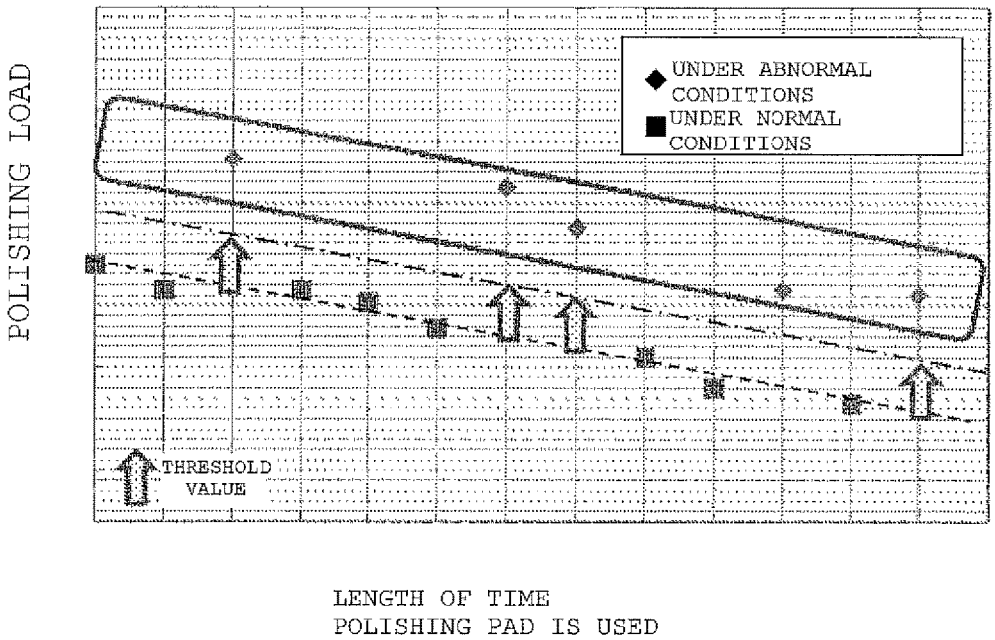
FIG. 6 is a diagram indicating the results of temporal changes in the polishing load in Example 2.

In FIG. 6, the results of the polishing loads under normal conditions and under abnormal conditions, the polishing loads transitioning with the length of time the polishing pad is used, are indicated. As indicated in FIG. 6, it is clear that the polishing loads under normal conditions and under abnormal conditions are reduced, exhibiting almost the same slope, with the length of time the polishing pad is used. The reason is as follows: while the fixed position of the upper turn table is set so as to be the same position at all times, the thickness of the polishing pad is reduced with the length of time the polishing pad is used.

As described above, since the polishing loads under normal conditions and under abnormal conditions are reduced, exhibiting almost the same slope, there was no need to change the threshold value.

While double-side polishing of the wafer was repeated, the polishing load under normal conditions was updated in the following manner. Update was performed by using the polishing load measured when the wafer was properly held as the polishing load under normal conditions every time polishing was finished. That is, the polishing load under normal conditions which was referred to at the time of judgment of abnormal holding was set so as to be the polishing load under normal conditions which was updated at the time of the last polishing.

By updating the polishing load under normal conditions as described above, it was possible to avoid an incorrect judgment of the occurrence of abnormal holding of the wafer from being made by temporal changes in the polishing pad.

It is to be understood that the present invention is not limited in any way by the embodiment thereof described above. The above embodiment is merely an example, and anything that has substantially the same structure as the technical idea recited in the claims of the present invention and that offers similar workings and benefits falls within the technical scope of the present invention.

The invention claimed is:

1. A workpiece processing apparatus, comprising:

an upper turn table, a load cell disposed above and connected to the upper turn table, a lower turn table, a carrier having a holding hole for a workpiece, the carrier configured to be interposed between the upper turn table and the lower turn table, the workpiece having an upper surface and a lower surface, and a control unit that is provided with a storage medium on which a reference polishing load measured when the upper turn table is moved downward to a fixed position in a state in which the workpiece is properly held between the upper turn table and the lower turn table in the holding hole of the carrier is recorded in advance, the control unit being configured to:

calculate a difference between a polishing load measured via the load cell that connects to the upper turn table when the upper turn table is moved downward to the fixed position in a state in which the workpiece is held between the upper turn table and the lower turn table in the holding hole of the carrier and the reference polishing load recorded in advance on the storage medium, and before the workpiece is processed, judge an occurrence of abnormal holding of the workpiece if the calculated difference exceeds a threshold value;

wherein the workpiece processing apparatus is configured such that both surfaces of the workpiece can be processed at a same time when the workpiece is held in the holding hole of the carrier and the carrier is interposed between the upper turn table and the lower turn table.

2. The workpiece processing apparatus according to claim 1, wherein the workpiece processing apparatus is a double-side polishing apparatus or a double-side lapping apparatus.

3. The workpiece processing apparatus according to claim 2, wherein the control unit is configured to update the reference polishing load recorded on the storage medium in advance in accordance with temporal changes in a polishing pad of the double-side polishing apparatus or a lapping turn table of the double-side lapping apparatus.

4. A workpiece processing method comprising steps of:

providing a workpiece processing apparatus comprising an upper turn table, a load cell disposed above and connected to the upper turn table, a lower turn table, a carrier having a holding hole for a workpiece, the workpiece having an upper surface and a lower surface, the carrier configured to be interposed between the upper turn table and the lower turn table, and a control unit, the workpiece processing apparatus being capable of processing both surfaces of the workpiece at a same time by holding the workpiece in the holding hole of the carrier by inserting the workpiece thereinto, moving the upper turn table downward to a fixed positioner thereby interposing the carrier holding the workpiece between the upper turn table and the lower turn table;

recording in advance a reference polishing load measured when the upper turn table is moved downward to the fixed position in a state in which the workpiece is properly held between the upper turn table and the lower turn table in the holding hole of the carrier, the recorded reference polishing load being recorded in a storage medium of the control unit;

measuring a polishing load via the load cell that connects to the upper turn table, the polishing load being measured after the upper turn table is moved downward to the fixed position in a state in which the workpiece is held between the upper turn table and the lower turn table in the holding hole of the carrier;

calculating a difference via the control unit between the polishing load measured via the load cell when the upper turn table is moved downward to the fixed position in a state in which the workpiece is held between the upper turn table and the lower turn table in the holding hole of the carrier and the recorded reference polishing load; and if the calculated difference exceeds a threshold value before the workpiece is processed, judging an occurrence of abnormal holding of the workpiece via the control unit, moving the upper turn table upward from the fixed position, ejecting the workpiece from the holding hole of the carrier, reinserting the workpiece into the holding hole of the carrier and, after reinsertion, processing the workpiece if a calculated difference assessed after reinsertion does not exceed the threshold value; wherein processing the workpiece comprises polishing both surfaces of the workpiece at the same time.

5. The workpiece processing method according to claim 4, wherein the processing performed on the workpiece is double-side polishing or double-side lapping.

6. The workpiece processing method according to claim 5, comprising a step of:

updating the reference polishing load recorded in advance in accordance with temporal changes in a polishing pad which is used in the double-side polishing or a lapping turn table which is used in the double-side lapping.

* * * * *